US005433506A

United States Patent [19]

Jensen

[11] Patent Number: 5,433,506

[45] Date of Patent: Jul. 18, 1995

[54] PNEUMATICALLY-CUSHIONED CHAIR

[76] Inventor: Hans C. Jensen, 901-1600 Beach Ave., Vancouver, British Columbia, Canada, V6G 1Y6

[21] Appl. No.: 159,130

[22] Filed: Nov. 30, 1993

[51] Int. Cl.[6] ..... A47C 7/14

[52] U.S. Cl. ..... 297/284.3; 297/452.41; 297/DIG. 3; 297/DIG. 8; 297/284.6

[58] Field of Search ..... 297/452.41, DIG. 3, 297/284.1, 284.3, 284.6, DIG. 8, 440.14; 5/644, 449, 453–456

[56] References Cited

U.S. PATENT DOCUMENTS

| | | | |
|---|---|---|---|
| 2,164,715 | 7/1939 | Krainbill | 297/440.14 X |
| 2,686,006 | 8/1954 | Hasselquist | 5/454 X |
| 3,192,541 | 7/1965 | Moore . | |
| 3,363,941 | 1/1968 | Wierwille . | |
| 3,784,994 | 1/1974 | Kery . | |
| 3,792,501 | 2/1974 | Kery | 297/452.41 X |
| 3,867,732 | 2/1975 | Morrell . | |
| 3,982,786 | 9/1976 | Burgin et al. . | |
| 4,132,228 | 1/1979 | Green | 297/284.3 X |
| 4,190,286 | 2/1980 | Bentley . | |
| 4,552,402 | 11/1985 | Huber et al. . | |
| 4,619,481 | 10/1986 | Grudzinskas . | |
| 4,629,253 | 12/1986 | Williams | 297/DIG. 8 X |
| 4,679,264 | 7/1987 | Mollura . | |
| 4,707,027 | 11/1987 | Horvath et al. . | |
| 4,707,872 | 11/1987 | Hessel . | |
| 4,762,231 | 8/1988 | Kiselewski | 5/456 X |
| 4,799,276 | 1/1989 | Kadish . | |
| 5,082,326 | 1/1992 | Sekido et al. | 297/284.6 |

*Primary Examiner*—Kenneth J. Dorner
*Assistant Examiner*—Milton Nelson, Jr.
*Attorney, Agent, or Firm*—Oyen Wiggs Green & Mutala

[57] ABSTRACT

Prior pneumatically-cushioned chairs require over-inflation of the cushions to maintain a neat appearance for the chair when it is unoccupied. A chair is described having an array of pneumatically-inflated cushions each having an air storage reservoir which is biassed to force air into the cushions when the chair is unoccupied, providing a neat firm appearance, but to allow the volume of air in the cushions to be gradually reduced when placed under load to provide a gentler support.

7 Claims, 4 Drawing Sheets

PNEUMATICALLY-CUSHIONED CHAIR

TECHNICAL FIELD

The invention relates to cushioned seats and chairs, and more particularly to seats having variably-inflatable cushions.

BACKGROUND ART

Chairs, sofas and the like which have cushions which conform to the user's body in order to avoid pressure points are desirable not only from the standpoint of general comfort, but also for medical reasons to support burn victims and avoid bedsores on invalids. Inflatable bladders have been used in the prior art to provide vehicle seat cushions of variable firmness. See for example Horvath et al. U.S. Pat. No. 4,707,027 issued Nov. 17, 1987; Morrell U.S. Pat. No. 3,867,732 issued Feb. 5, 1975; Bentley U.S. Pat. No. 4,190,286 issued Feb. 26, 1980; Huber et al. U.S. Pat. No. 4,552,402 issued Nov. 12, 1985; Wierwille U.S. Pat. No. 3,363,941 issued Jan. 16, 1968; and Grudzinskas U.S. Pat. No. 4,619,481 issued Oct. 28, 1986. In a vehicle seat application, firm support is the primary concern, rather than the gentle support required for medical applications or reclining chairs for relaxation. In the latter applications, considerable "give" in the supporting surface is desired so that the support is spread out over the entire surface of the user's body. From an aesthetic standpoint, however, especially for reclining chairs for residential homes, it is desirable that the surface of the chair have a firm, neat appearance when the chair is unoccupied.

DISCLOSURE OF INVENTION

The present invention therefore provides a reclining chair having pneumatically inflatable cushions which conform resiliently to the user's body but return to a fully inflated state when the chair is unoccupied. The invention provides an apparatus for supporting a human body comprising a) a resilient layer of cushioning material; b) a rigid support layer; c) an array of pneumatically-inflatable elastomeric bladders extending between the resilient layer and the support layer, each bladder having a deformable body-supporting upper surface; d) a collapsible air reservoir communicating with each bladder; e) biassing means for biassing the collapsible reservoir to a collapsed position when the apparatus is not supporting a human body; and f) means for selectively providing air under pressure to each bladder.

BRIEF DESCRIPTION OF DRAWINGS

In drawings which illustrate a preferred embodiment of the invention.

BEST MODE(S) FOR CARRYING OUT THE INVENTION

Figure 2:
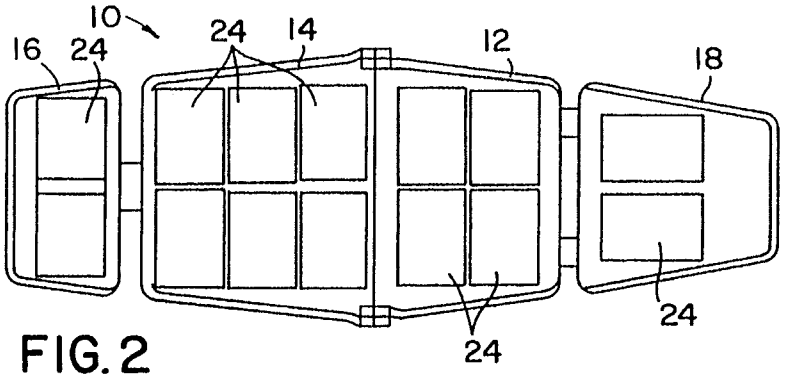
FIG. 2 is a top view of the chair of FIG. 1, with the layer of foam cushion removed to show the location of the inflatable bladders.
Figure 1:
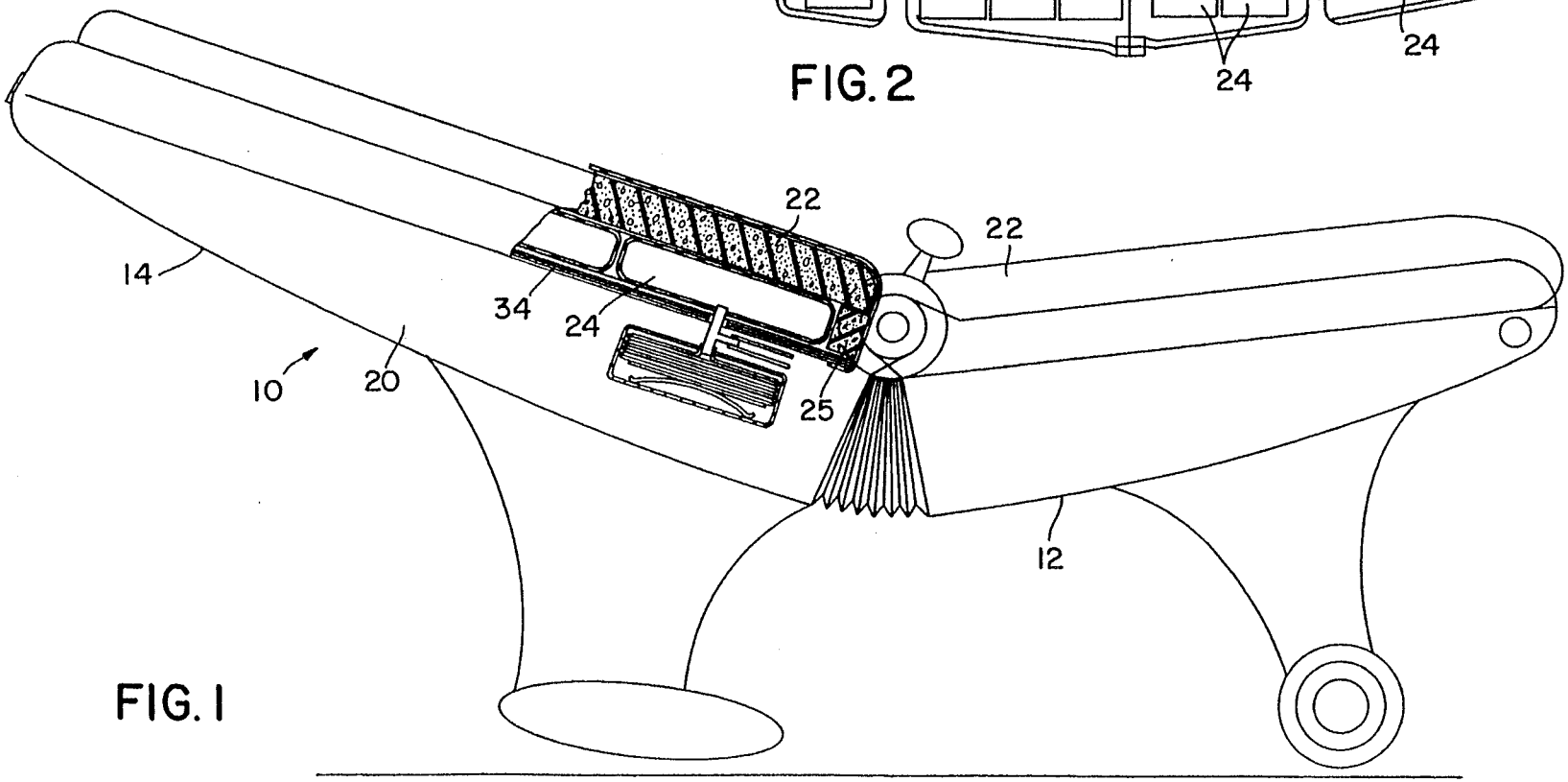
FIG. 1 is a side elevation, partly in cross-section of a chair incorporating the invention.

FIG. 2 illustrates in top view a reclining chair 10 having a seat support section 12, back support section 14, head rest 16 and foot rest 18. As shown in FIG. 1, each section has a rigid support backing 20, a layer of foam cushion material 22, such as foam rubber, and an array of inflatable bladders 24. Foam rubber sections 25 are provided around the sides and ends of the cushion. The foam layer 22, 25 will have a fabric or leather covering 26 (FIG. 3).

Figure 5:
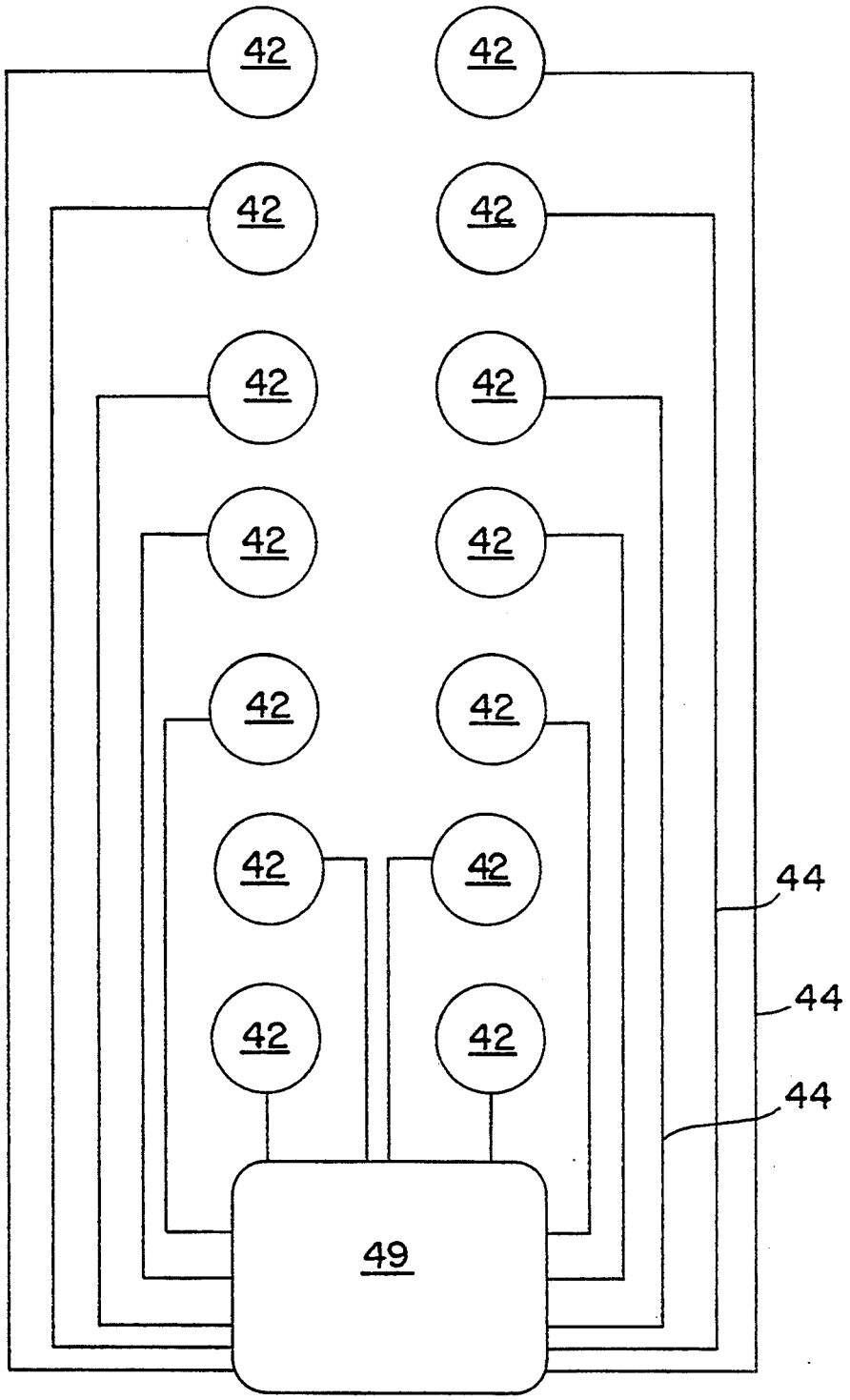
FIG. 5 is a schematic diagram illustrating the connection of bellow units to a manifold.

Bladders 24 are formed of an air/liquid impervious material such as vinyl. The bladders 24 are contained in hollow chamber 28 formed by the underside 30 of foam cushion 22, the inner surface 32 of foam cushions 25, and rigid support panel 34. A passageway 38 is provided in support panel 34 for each bladder 24 to permit passage of a tube 40 which communicates between the interior of each associated bladder 24 and a bellows 42, and has a T-connection 46 which connects the tube 40, and thus the interior of bladder 24 and bellows 42, to a control manifold 49 (FIG. 5) by way of air conduit 44. Manifold 49 has manual or automatic pump means to provide a selected amount of air under pressure to any given air conduit 44.

Each bellows 42 is supported in a rigid cylindrical housing 48. The bellows 42 is biassed to a collapsed position by a leaf spring 50. The strength of spring 50 is selected so it will compress bellows 42 and return bladder 24 to a fully expanded condition when no load is placed on the cushion 22.

Figure 3:
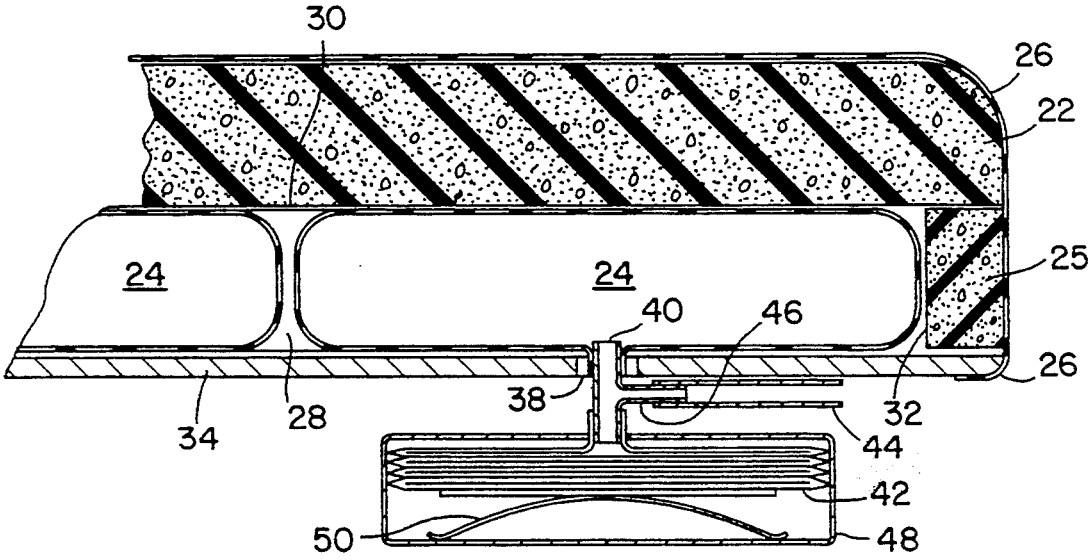
FIG. 3 is a cross-section of a cushion according to the invention in a rest position.
Figure 4:
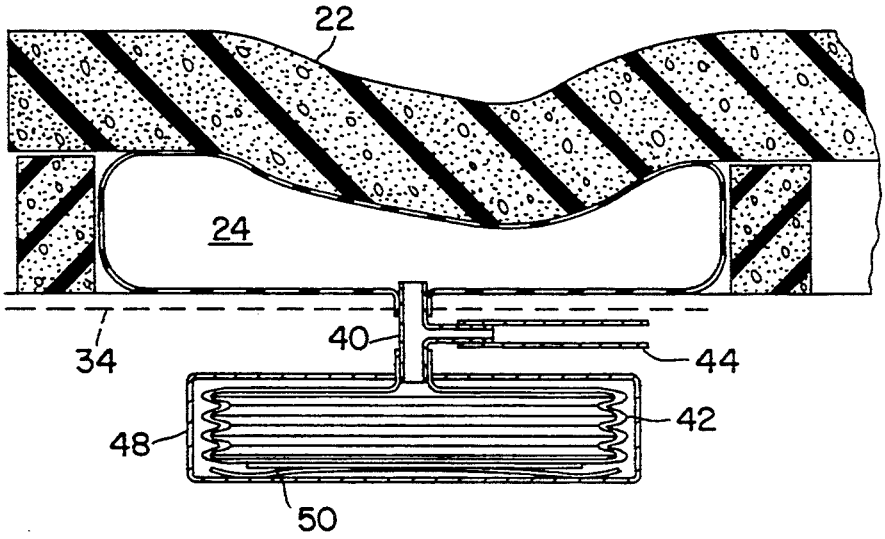
FIG. 4 is a cross-section of a cushion according to the invention under load.

To operate the chair, manifold 49 is activated so that bladders 24 are firmly filled with air through conduits 44, with bellows 42 in the collapsed state shown in FIG. 3. When the user lies down on surface 26 of cushions 22, the weight of the user gradually forces air from bladders 24 into bellows 42, allowing the user to gradually sink into the cushions, until spring 50 is completely collapsed, as shown in FIG. 4. In that state the bladders 24 will conform freely and gently to the user's body surface. Also the user can choose to selectively add or reduce the amount of air in any given bladder 24 by means of manifold 49. When the user gets off the chair, spring 50 collapses bellows 42 and bladder 24 is returned to a firm condition, giving the chair a neater appearance than would be the case if the cushions still reflected the contours of the user's body.

While individual adjustment of the bladders 24 by manifold 49 is preferred, a system could be provided in which certain bladders 24 are connected to a common source of pressurized air so air can flow between them, or the bladders can be selectively isolated. Generally it is not desirable that air flow freely among all the bladders, as that results in a cushioning surface which tends to be unstable. Liquids other than air could be used in the system.

Figure 6:
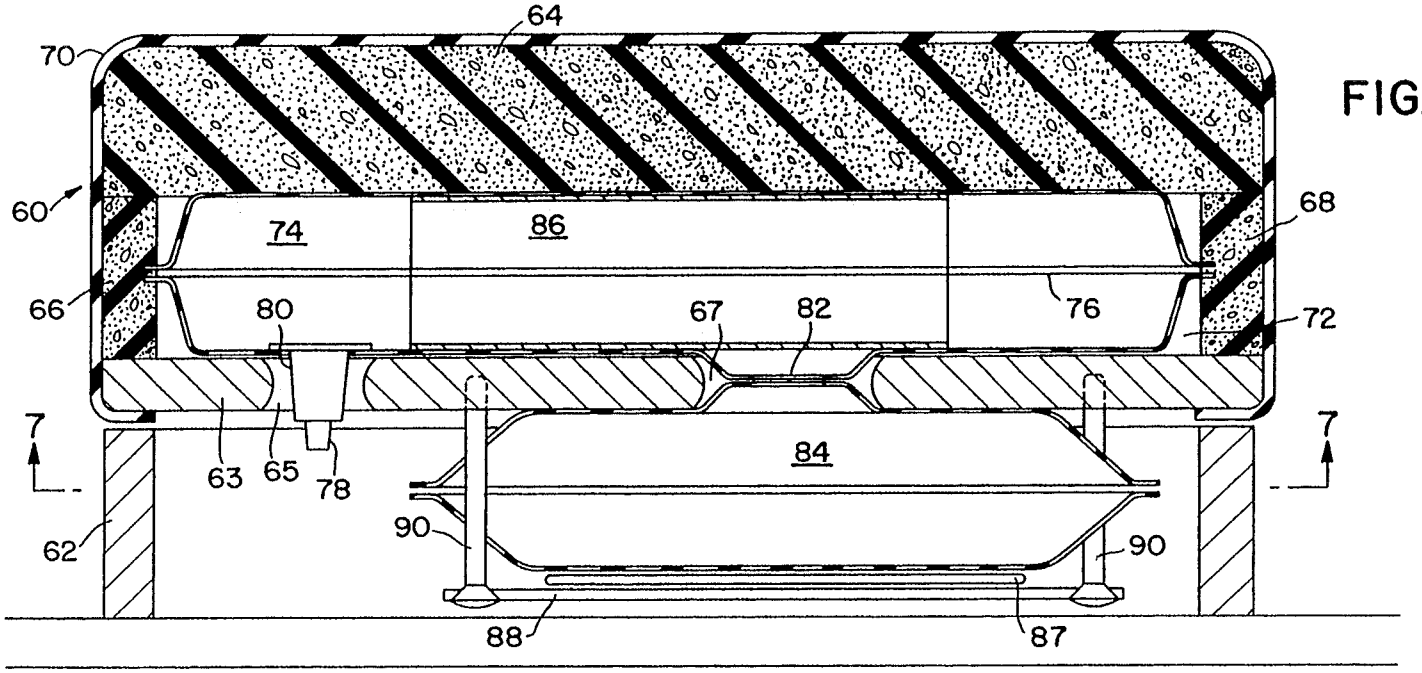
FIG. 6 is a cross-section of a cushion according to a second embodiment of the invention.
Figure 7:
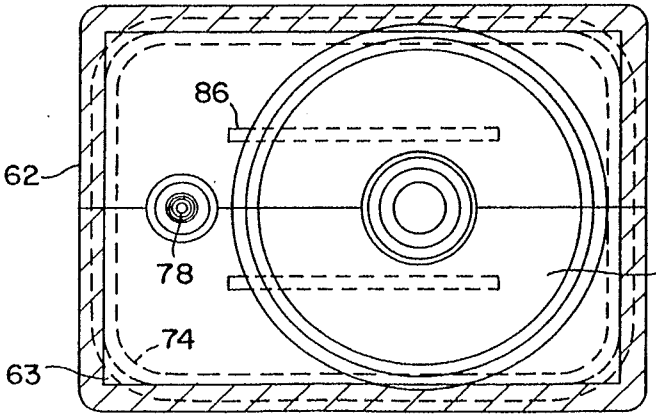
FIG. 7 is a bottom cross-sectional view of the cushion shown in FIG. 6 taken along lines 7—7 in FIG. 6.

FIG. 6 and 7 illustrate an embodiment of the invention in which each bladder unit forms part of a self-contained, modular cushion unit 60. Cushion unit 60 includes a lower support frame 62 on which is mounted rigid support panel 63, on which are mounted in turn main foam cushion 64 and side foam rubber cushion pieces 66, 68. The foam rubber cushions are covered with a flexible fabric or leather covering 70. Holes 65, 67 are provided in panel 63.

Panel 63 and cushions 64, 66, 68 thus form a hollow chamber 72 in which is mounted the bladder 74. Bladder 74 is preferably formed of two halves of 30 mil (30/1,000 inch thick) vinyl which are welded together along weld 76. A rigid tube 78 is provided which communicates with the interior of the bladder 74 through aperture 80, and to which the conduit 44 from the manifold 49 may be connected. A second aperture 82 in bladder 74 permits communication with vinyl bellows 84. Two rectangular partitions 86 are provided which are welded along the upper and lower edges thereof to the inner surface of bladder 74, to prevent the bladder from ballooning outwardly under pressure. Bellows 84 may also be welded from two vinyl halves.

In this embodiment, bellows 84 is compressed by a coil spring 87. While the bellows 84 is shown in an expanded state in FIG. 6, even though there is no load on the cushion 64, normally in that condition spring 87 would have partially collapsed bellows 84, unless considerable air presssure had been introduced into the bladder 74. Spring 87 is mounted on a panel 88 which is fixed on rigid supports 90 which are connected to panel 63. The entire unit 60 is therefore removable from the chair or other article as a modular unit, after the connection to tube 78 is removed.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Apparatus for supporting a human body comprising:

a) a resilient layer of cushioning material;

b) a rigid support layer;

c) an array of pneumatically-inflatable elastomeric bladders extending between said resilient layer and said support layer, each said bladder having a deformable body-supporting upper surface;

d) a plurality of collapsible air reservoirs, each said collapsible air reservoir communicating with a unique one of said bladders;

e) a plurality of biassing means for biassing an associated one of said collapsible reservoirs to a collapsed position when said apparatus is not supporting a human body and permitting said associated one of said collapsible reservoirs to expand to an inflated position when said apparatus is supporting a human body; and f) means for selectively providing air under pressure to each said bladder;

wherein each said collapsible air reservoir comprises a resilient collapsible air-impervious element mounted in a rigid framework and each said biassing means comprises a spring having upper and lower pressure-applying surfaces acting between an associated collapsible air-impervious element and an associated rigid framework whereby said spring, when compressed, applies pressure through said lower surface to said associated rigid framework and applies pressure through said upper surface to said associated collapsible air reservoir, and whereby each said spring is fully compressed when said associated collapsible air-impervious element is in an inflated position. When said apparatus is supporting a human body.

2. The apparatus of claim 1 wherein each said collapsible air reservoir communicates with said unique one of said bladders through an aperture in said support layer.

3. The apparatus of claim 1 wherein said means for providing air under pressure comprises a manifold communicating independently with each said bladder.

4. The apparatus of claim 3 wherein said means for providing air under pressure further comprises means for independently regulating the flow of air into each said bladder.

5. Apparatus for supporting a human body comprising:

a) a resilient layer of cushioning material;

b) a rigid support layer;

c) an array of pneumatically-inflatable elastomeric bladders extending between said resilient layer and said support layer, each said bladder having a deformable body-supporting upper surface;

d) a plurality of collapsible air reservoirs, each said collapsible air reservoir communicating with a unique one of said bladders;

e) a plurality of biassing means for biassing an associated one of said collapsible reservoirs to a collapsed position when said apparatus is not supporting a human body and permitting said associated one of said collapsible reservoirs to expand to an inflated position when said apparatus is supporting a human body; and f) means for selectively providing air under pressure to each said bladder;

wherein each said collapsible air reservoir communicates with said means for providing air under pressure and said unique one of said bladders through a T-shaped pipe.

6. A chair having an upper cushioned surface, said chair comprising:

a) a resilient layer of cushioning material;

b) a rigid support layer;

c) an array of pneumatically-inflatable elastomeric bladders extending between said resilient layer and said support layer, each said bladder having a deformable body-supporting upper surface, thereby forming an array of upper surfaces of said bladders extending across substantially the entire area between said cushioning layer and said support surface;

d) a plurality of collapsible air reservoirs each said collapsible air reservoir associated with and communicating with a unique one of said bladders, and being collapsible from a state of maximum inflation to a state of deflation;

e) a plurality of biassing means for biassing each said collapsible reservoir to a collapsed position when said associated bladder is not supporting a load and permitting each said collapsible reservoir to expand to an inflated position when said associated bladder is supporting a load; and f) means for selectively providing air under pressure to each said bladder;

wherein said collapsible reservoirs and said biassing means are adapted so that when said chair is supporting a user, said plurality of biassing means are in a state of complete collapse and said associated bladders are partially inflated.

7. The apparatus of claim 6 wherein each said bladder and associated collapsible air reservoir are contained in a modular cushioned unit.

* * * * *